United States Patent [19]

Currey

[11] Patent Number: 4,977,848

[45] Date of Patent: Dec. 18, 1990

[54] SEAT PEDESTAL MOUNT

[76] Inventor: Lesley B. Currey, P.O. Box 238, Monticello, Ark. 71655

[21] Appl. No.: 342,561

[22] Filed: Apr. 24, 1989

Related U.S. Application Data

[63] Continuation-in-part of Ser. No. 239,327, Sep. 1, 1988.

[51] Int. Cl.[5] ..... B63B 29/00

[52] U.S. Cl. ..... 114/363; 248/158; 297/349

[58] Field of Search ..... 114/363; 297/344, 345, 297/349; 248/188.1, 158; 403/367, 371

[56] References Cited

U.S. PATENT DOCUMENTS

| | | | |
|---|---|---|---|
| 3,541,882 | 11/1970 | Testa | 403/371 X |
| 4,587,921 | 5/1986 | Currey | 114/363 |
| 4,712,811 | 12/1987 | Wier | 403/371 |

*Primary Examiner*—Sherman Basinger

[57] ABSTRACT

A seat pedestal mount for boats, which is characterized by strength, stability, ease of installation and convenience in maintenance. The seat pedestal mount includes a base plate for mounting in the deck of a boat, the base plate having a plate flange for securing the base plate to the boat deck and a downwardly-extending, tapered bushing seat for recessed mounting in the boat deck. A tapered, slotted bushing is removably seated in the bushing seat and receives a seat pedestal extension or a seat pedestal, such that the seat pedestal extension or seat pedestal is rigidly, yet removably, stabilized in the bushing seat of the base plate. When a pedestal extension is used, the seat pedestal element of a seat frame fits into the top end of the pedestal extension and the bottom end of the pedestal extension is seated in the slotted bushing, to mount the seat in rigid relationship on the deck of the boat. In a preferred embodiment of the invention, a pedestal extension extension is utilized as an accessory to the seat pedestal mount and a threaded nipple is provided in the bottom end of the pedestal extension for engaging threads provided in the base of the bushing seat, in order to further stabilize the pedestal extension in the slotted bushing and the slotted bushing in the bushing seat of the seat pedestal mount.

18 Claims, 1 Drawing Sheet

SEAT PEDESTAL MOUNT

CROSS-REFERENCE TO RELATED APPLICATIONS

This application is a Continuation-In-Part of my copending Pat. application Ser. No. 07/239,327, filed Sept. 1, 1988, entitled "Seat Pedestal".

BACKGROUND OF THE INVENTION

Field of the Invention

This invention relates to pedestal-mounted seats in fishing and pleasure boats and more particularly, to a new and improved seat pedestal mount for fishing boats. In a first preferred embodiment, the seat pedestal mount of this invention is characterized by a tapered bushing seat topped by a plate flange adapted for mounting on the deck of a boat, with the tapered bushing seat recessed into the deck and a tapered, slotted, plastic bushing fitted in the bushing seat of the base plate for rigidly receiving and removably mounting a pedestal extension or seat pedestal. In a second preferred embodiment of the invention, the bottom end of a specially designed pedestal extension is fitted with a downwardly-projecting mount nipple which is threaded to engage threads provided in the bottom of the bushing seat, in order to further secure the pedestal extension in the bushing and bushing seat. In both embodiments of the invention a coil spring may be provided in the base of the bushing seat, to facilitate easily removal of the slotted bushing from the bushing seat. The seat pedestal element of a seat unit fits in the top end of the pedestal extension and serves to stabilize the seat unit to minimize rocking and rotating movement of the pedestal extension and the seat unit with respect to the deck of the boat, both when the seat is occupied and unoccupied.

One of the problems which exists with prior art boat seat pedestal mounts is that of excessive tolerance between the seat pedestal and the pedestal mount, which tolerance causes a rocking action from front to rear and from side to side, as well as a rotating motion, responsive to wave action as the boat moves through the water. These movements are particularly aggravating under circumstances where the occupant is fishing, as they disturb the natural rhythm of bait casting and retrieving. Continued rocking from front-to-rear or side-to-side, as well as rotational movement of the seat pedestal, usually results in gradual accentuation and aggravation of this motion, since the pedestal mount or seat pedestal support may be slowly "wallowed", deformed, worn or cracked, thereby contributing to additional undesirable seat motion.

DESCRIPTION OF THE PRIOR ART

Typical of the prior art patents which detail seat pedestal mounts for boats is U.S. Pat. No. 4,587,921, dated May 13, 1986, to Larry B. Currey, entitled "Mounting for Boating Equipment". This patent includes a seat pedestal assembly for use on boats such as bass boats. In the Currey design, the pedestal extension has a nipple of reduced diameter, with a threaded portion thereon. The base plate includes a threaded nut which is welded to the bottom thereof for receiving the threaded portion of the nipple and securing the extension to the base plate. In another embodiment, the base plate can be threaded along substantially the entire length of the cylindrical portion thereof. Other patents which detail various types of seat pedestal mounts for boats are as follows: U.S. 1,224,405, dated May, 1917, to Wienstadt; U.S. Pat. No. 1,636,966, dated Jul., 1927 to Martin; U.S. Pat. No. 2,379,572, dated Jul., 1945 to Gibson; U.S. 2,974,625, dated Mar., 1961, to Lang; U.S. Pat. No. 3,151,910, dated Oct., 1964, to Larson; U.S. Pat. No. 3,415,475, dated Dec., 1968, to Goodman; U.S. Pat. No. 3,620,494, dated Nov., 1971, to DeGaston; U.S. Pat. No. 3,642,320, dated Feb. 1972, to Ward; U.S. 3,802,374, dated Apr., 1974, to Brown; U.S. Pat. No. 3,825,962, dated Jul., 1974 to Grounds, et al; U.S. Pat. No. 3,890,918, dated June, 1975, to Sell; U.S. Pat. No. 3,919,963, dated Nov., 1975, to Cox; U.S. Pat. No. 3,949,968, dated Apr., 1976, to Sell; U.S. Pat. No. 4,008,500, dated Feb., 1977, to Hall; U.S. 4,030,749 dated June, 1977, to Strahm; U.S. Pat. No. 4,106,143, dated Aug., 1978, to Lucas; and U.S. Pat. No. 4,148,465, dated Apr. 1979, to Bowman.

It is an object of this invention to provide a new and improved seat pedestal mount for boats and small fishing boats in particular, which seat pedestal mount includes a base plate adapted for mounting in the deck of the boat, a tapered bushing seat shaped in the base plate and a slotted bushing fitted in the bushing seat for receiving a seat pedestal extension in tight, but removable relationship, wherein the seat pedestal extension is designed to further receive the seat pedestal element of a seat frame, for mounting the seat frame in secure configuration on the boat deck.

Another object of the invention is to provide a seat pedestal mount that is substantially free of rocking and rotational movement relative to the boat deck, which seat pedestal mount is characterized in a preferred embodiment by a base plate having a plate flange of desired size and shape adapted for mounting on a boat deck, the plate flange having a tapered bushing seat extending downwardly therefrom, for recessing in the boat deck and receiving a tapered, multi-slotted, plastic bushing, wherein the slotted bushing is designed to receive and tighten a seat pedestal or a seat pedestal extension in the bushing seat of the base plate and securely mount a seat on the boat deck.

Yet another object of this invention is to provide a new and improved seat pedestal mount for fishing boats, which seat pedestal mount is characterized by a cast metal base plate having a flat plate flange provided with spaced openings for mounting on a boat deck and a downwardly-extending, tapered bushing seat designed to receive a removable, tapered bushing having a first slot extending longitudinally through the top thereof and a second slot projecting longitudinally through the bottom, for removably locking one end of a pedestal extension or a seat pedestal of a seat frame therein, wherein the seat pedestal may be mounted and secured directly in the slotted bushing and bushing seat or in the pedestal extension, in removable relationship.

Still another object of this invention is to provide a new and improved seat pedestal mount for receiving the seat pedestal of a seat frame, which seat pedestal mount further includes a base plate having a plate flange for mounting on the deck of a boat, a downwardly-extending, internally-tapered bushing seat integrally cast with the plate flange and having a bushing seat shoulder and base of uniform diameter, respectively, for receiving and seating a correspondingly-shaped, removable, double-slotted plastic lock bushing having a cap and leg portion, also of uniform diameter, respectively. A hollow pedestal extension is designed to fit in the slotted and partially tapered bushing and in a most preferred embodiment of the invention, the bottom end of the pedestal extension is fitted with a threaded nipple for engaging corresponding threads located in the bushing seat and tightening the pedestal extension in the bushing, to receive the seat pedestal of a seat frame in secure, but removable relationship. A coil spring may also be provided in the bushing seat to aid in removing the bushing from the bushing seat, such that even when unoccupied, the seat remains stabilized with respect to the boat deck when the bushing rides upwardly in the bushing seat responsive to spring tension, due to the uniform diameter of the bushing seat shoulder and bushing cap, as well as the bushing seat base and bushing leg combination, respectively.

SUMMARY OF THE INVENTION

These and other objects of the invention are provided in a new and improved seat pedestal mount for use in stabilizing a seat on the deck of a boat, which seat pedestal mount is characterized in a first preferred embodiment by a shaped metal base plate having a top flange fitted with spaced apertures for receiving mount bolts or studs and mounting on the boat deck, and a bushing seat having internal shoulder and base elements of uniform diameter, respectively, connected by a tapered inner wall, the bushing seat extending downwardly from the top flange into the boat deck, for receiving a flexible, plastic, correspondingly-shaped, double-slotted bushing therein. A coil spring may be provided in the bushing seat beneath the bushing to facilitate easy removal of the bushing from the bushing seat and a seat pedestal may be securely seated in the bushing and the bushing seat to mount the seat on the boat deck. In a second preferred embodiment of the invention a round, hollow seat pedestal extension is provided with a downwardly-extending, threaded nipple on the bottom end thereof and the pedestal extension is seated in the bushing, with the threaded nipple engaging internal threads provided in the base of the bushing seat, in order to threadibly tighten the pedestal extension in the bushing and bushing seat and secure the seat pedestal of a seat frame inside the pedestal extension for supporting a fisherman in the seat over the boat deck.

BRIEF DESCRIPTION OF THE DRAWING

The invention will be better understood by reference to the accompanying drawing, wherein.

DESCRIPTION OF THE PREFERRED EMBODIMENTS

Figure 1:
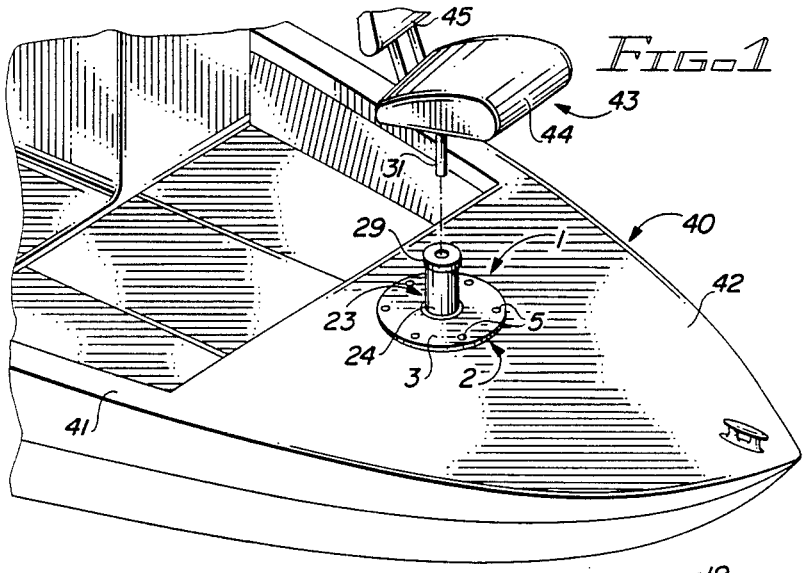
FIG. 1 is a perspective view of the seat pedestal mount of this invention secured to the front deck of a fishing boat.
Figure 4:
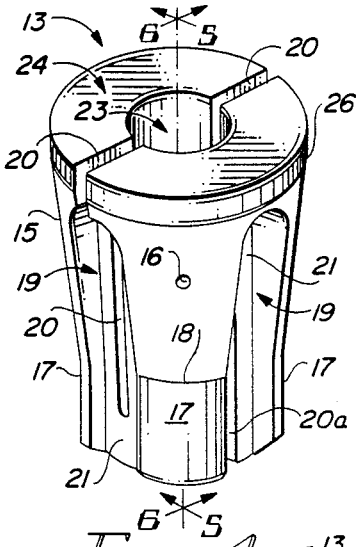
FIG. 4 is a perspective view of the slotted bushing.
Figure 2:
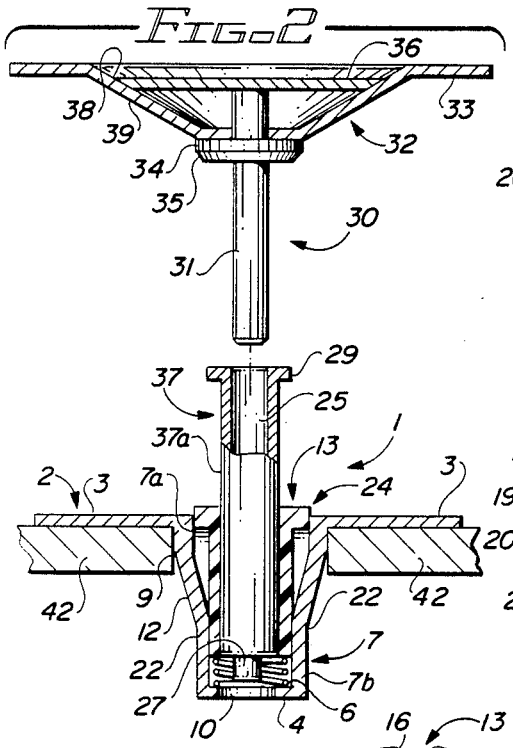
FIG. 2 is a sectional view of a preferred embodiment of the seat pedestal mount of this invention, with a preferred seat frame illustrated in exploded configuration with respect to the seat pedestal mount.
Figure 7:
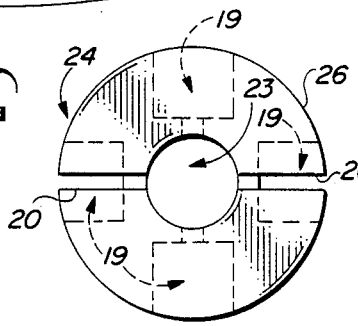
FIG. 7 is a top view of the slotted bushing illustrated in FIGS. 4–6.
Figure 5:
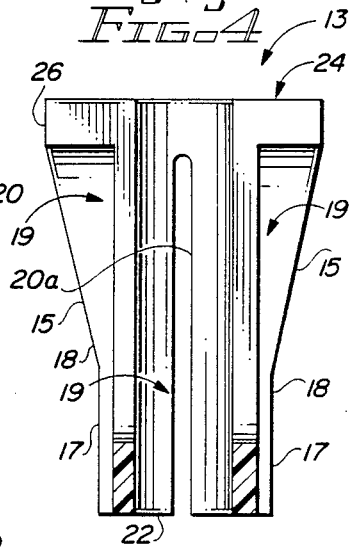
FIG. 5 is a sectional view taken along line 5—5 of the slotted bushing illustrated in FIG. 4.
Figure 8:
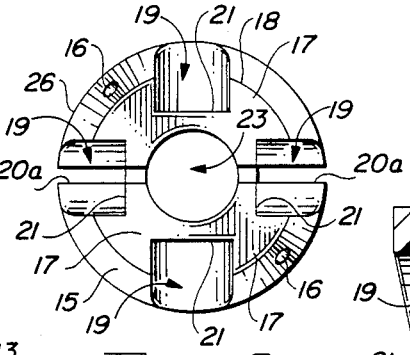
FIG. 8 is a bottom view of the slotted bushing illustrated in FIGS. 4–7.
Figure 6:
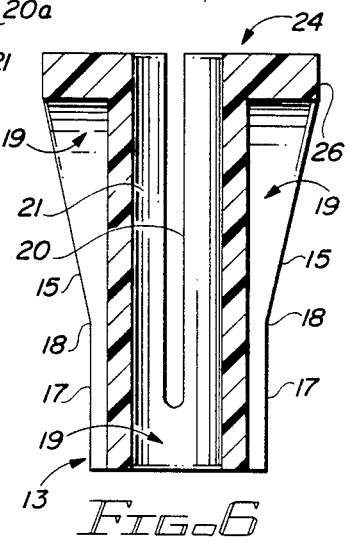
FIG. 6 is a sectional view taken along line 6—6 of the slotted bushing illustrated in FIG. 4.
Figure 3:
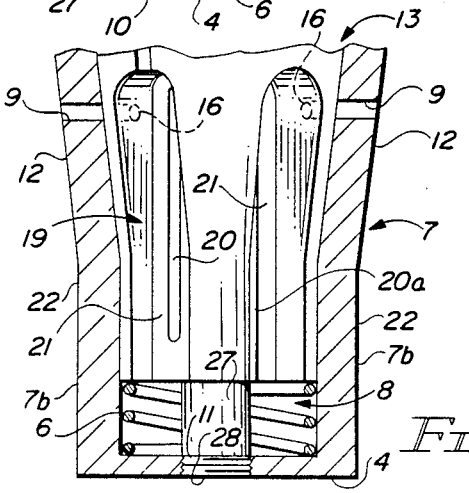
FIG. 3 is a sectional view of the lower portions of the bushing seat and slotted bushing.

Referring initially to FIGS. 1–3 of the drawings, the seat pedestal mount of this invention is generally illustrated by reference numeral 1. The seat pedestal mount 1 is characterized by a metal base plate 2, which includes an outwardly-extending, round plate flange 3, secured to the front deck 42 of a boat 40, as further illustrated in FIG. 1 and as hereinafter further described. Spaced flange bolt holes (not illustrated) are provided near the periphery of the plate flange 3, and deck studs (not illustrated) mounted on the front deck 42, project through the flange bolt holes and receive cooperating flange nuts 5 for mounting the plate flange 3 to the front deck 42, as illustrated in FIG. 1. Alternatively, other fasteners such as screws and bolts can be used to secure the plate flange 3 to the front desk 42, according to the knowledge of those skilled in the art. A bushing seat 7 extends downwardly from the plate flange 3 to complete the base plate 2 and in a preferred embodiment of the invention, the bushing seat 7 is cast integrally with the plate flange 3 in a suitable metal, such as aluminum, in order to provide a base plate 2 of maximum strength. A bushing seat shoulder **7*a* of uniform diameter is shaped in the inside top periphery of the bushing seat 7, as illustrated in FIG. 2 and as further illustrated in FIGS. 2 and 3, a spring chamber 8 is provided in the bushing seat base 7*b* of the bushing seat 7, in order to receive a coil spring 6. The bushing seat base 7*b* has a uniform diameter extending downwardly from the bushing seat margin 22, which terminates the bushing seat taper 12, as illustrated in FIGS. 2 and 3. A pair of retaining apertures 9 are provided in oppositely-disposed relationship in the wall of the bushing seat 7 at the bushing seat taper 12, as further illustrated in FIG. 2, for a purpose which will be hereinafter further described. A bushing seat opening 10 is provided in the bottom 4 of the bushing seat 7, which bushing seat opening 10 communicates with the spring chamber 8 and optional opening threads 11 may be provided in the bottom 4, bordering the bushing seat opening 10, as illustrated in FIG. 3**.

As illustrated in FIGS. 2–8, a tapered, double-slotted bushing 13 is characterized by a plastic body having a bushing bore 23 extending longitudinally therethrough. An external bushing taper 15 extends from a bushing cap 24, having a cap margin 26 of uniform diameter at the top thereof, to a bushing margin 18. Screws or other fasteners (not illustrated) of suitable design and size may be inserted through the retaining apertures 9 and into the aligned bushing apertures 16, when the bushing 13 is seated in the bushing seat 7, in order to prevent the bushing 13 from inadvertently exiting the bushing seat 7. Alternatively, tabs (not illustrated) can be shaped in the slotted bushing 13 for engaging corresponding retaining slots (not illustrated) provided in the bushing seat 7, as detailed in my copending U.S. Pat. application Ser. No. 07/239,327, to removably secure the slotted bushing 13 in the bushing seat 7. Parallel bushing depressions 19 extend longitudinally in radially spaced relationship through the wall of the bushing 13 at the bushing taper 15 and below the bushing margin 18, to define corresponding flat depression faces 21. Parallel top depression slots 20 are provided in a first set of oppositely-disposed depression faces 21, respectively, and extend longitudinally through the bushing cap 24, to terminate below the bushing margin 18. A set of parallel bottom depression slots **20*a* begin at the tops of oppositely-disposed depression faces 21 and extend longitudinally downwardly perpendicular to the top depression slots 20, through the entire length of the depression faces 21, to define a pair of bushing legs 17. The top depression slots 20 and bottom depression slots 20***a* facilitate wedging the slotted bushing 13 tightly against the pedestal extension 37, which is inserted in the bushing bore 23, and the correspondingly wedge-shaped inside surface of the bushing seat 7, as illustrated in FIGS. 2 and 3. Alternatively, the bushing bore 23 of the slotted bushing 13 can be sized to directly receive a seat pedestal 31 of corresponding diameter, without the use of a pedestal extension 37. In a most preferred embodiment of the invention, bushing threads 11 are provided in the bottom 4 of the bushing seat 7 and bordering the bushing seat opening 10, for removably locking the pedestal extension 37 or the seat pedestal 31 inside the slotted bushing 13 and bushing seat 7, as illustrated in FIG. 3 and as hereinafter further described.

Referring again to FIGS. 2 and 3 of the drawings, in a most preferred embodiment of the invention, the elongated pedestal extension 37 is characterized by a round extension tube 37*a*, having an extension tube bore 25, with an optional tube flange 29 shaped in the top thereof and provided with a downwardly-extending mount nipple 27, fitted with nipple threads 28, in the bottom end thereof. The extension tube bore 25 of the extension tube 37*a* is designed to receive a round seat pedestal 31, which is welded or otherwise attached to the seat frame 30, as further illustrated in FIGURES 1 and 8. Accordingly, when the pedestal extension 37 is mounted in the seat pedestal mount 1, the extension tube 37*a* is extended into the bushing bore 23 of the slotted bushing 13. As illustrated in FIG. 3, the nipple threads 28 then threadibly engage the opening threads 11 in the bottom 4 of the bushing seat 7 as the mount nipple 27 extends into the bushing seat opening 10 against the bias of the coil spring 6, such that the pedestal extension 37 may be tightly fitted into the slotted bushing 13. This tightening of the extension tube 37*a* in the slotted bushing 13 expands the bushing legs 17 and the upper portion of the slotted bushing 13 against the inside surface of the bushing seat 7, to insure a snug and tight fit. The pedestal extension 37 is thusly removably locked in the slotted bushing 13 and the bushing seat 7 of the base plate 2. Removal of the pedestal extension 37 from the slotted bushing 13 is effected by reversing the rotation of the pedestal extension 37 to unthread the mount nipple 27 from the opening threads 11, in a reverse operation of the installation procedure noted above. Alternatively, it will be appreciated that the extending end of the seat pedestal 31 may itself be fitted with a threaded nipple (not illustrated), in order to mount the seat pedestal 31 directly in the bushing 13 and the bushing seat 7, without using a pedestal extension 37, as desired. As illustrated in FIG. 2, under circumstances where neither the pedestal extension 37 nor the seat pedestal 31 are fitted with a threaded mount nipple 27, these elements of the seat frame 30 can be seated in the bushing bore 23 of the slotted bushing 13 and the weight of a person seated in the seat 43 compresses the coil spring 6 and stabilizes the pedestal extension 37 or the seat pedestal 31 in the slotted bushing 13 and the bushing seat 7, in the same manner as described above. Screws or other fasteners (not illustrated) of suitable design and size may be inserted through the retaining apertures 9 and into the aligned bushing apertures 16 when the bushing 13 is seated in the bushing seat 7, in order to prevent the bushing 13 from inadvertently exiting the bushing seat 7.

Referring again to FIGS. 1 and 2 of the drawing, in another most preferred embodiment of the invention, the seat frame 30 is further characterized by a square support plate 32, which includes a flat support plate flange 33 on the periphery thereof and a downwardly-extending, disk-shaped middle portion 39, which flattens at the bottom to receive a mount plate 34 and a cooperating mount block 35, as further illustrated in FIG. 1. The mount plate 34 and mount block 35 are welded or otherwise rigidly secured to the seat pedestal 31 and the center section of the support plate 32 is rigidly secured to the mount plate 34 in the same manner. A stiffening disk 36 is located in the center of the middle portion 39 and is welded thereto, to define a flange margin 38, which extends between the support plate flange 33 and the stiffening disk 36, as further illustrated in FIG. 8. Four flange slots (not illustrated) or openings are provided at the corners of the support plate flange 33, for mounting a support cushion 44 to the seat frame 30, as illustrated in FIG. 1.

The slotted bushing 13 illustrated in FIGS. 4–8 may be typically constructed of a suitable flexible plastic material such as polyethylene and polypropylene, in non-exclusive particular, which may be injection-molded or otherwise shaped in suitable sizes and provided with a bushing bore 23 of suitable size to receive and securely mount a pedestal extension 37 or a seat pedestal 31 of any desired diameter. The primary required characteristic of the material used to shape the slotted bushing 13 is resiliency, or "memory", wherein the respective top depression slot 20 and bottom depression slot 20*a* are "squeezed" and at least partially closed when the seat pedestal 31 or pedestal extension 37 is inserted in the bushing bore 23 of the slotted bushing 13 and the slotted bushing 13 is inserted in the bushing seat 7.

Referring again to FIGS. 1 and 2 of the drawing, it will be appreciated that in a typical installation, the seat pedestal mount 1 of this invention is mounted to the front deck 42 of the hull 41 in the boat 40 and the seat 43 is designed to mount on the seat frame 30, illustrated in FIG. 2, as heretofore described. It is understood that the seat 43 can be designed in any conventional fashion, with the support cushion 44 attached to the support plate flange 33 of the seat frame 30 using suitable mounting fasteners (not illustrated), according to the knowledge of those skilled in the art. Furthermore, a suitable backrest cushion 45 can be hinged to the support cushion 44 in conventional fashion, further according to the knowledge of those skilled in the art.

It will be appreciated that the seat pedestal mount of this invention is characterized by a convenient design which is highly reliable and may support the seat pedestal of a boat seat directly or by means of a pedestal extension, in a highly stable relationship. Furthermore, the seat pedestal mount is easily maintained and can be quickly removed for maintenance and cleaning purposes. Moreover, the seat pedestal mount of this invention can be mounted on substantially any boat of any size, but is primarily applicable to fishing boats, where the occupant may be casting and fishing for long periods of time and requires a stable platform from which to fish.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A seat pedestal mount for removably mounting a seat having a seat pedestal on a boat, comprising a base plate having a plate flange adapted for mounting on the boat; a bushing seat carried by said plate flange, said bushing seat having an internal bushing seat taper and adapted for recessing in the boat; bushing seat threads provided in the bottom of said bushing seat and a pedestal extension having one end adapted to receive the seat pedestal and a threaded nipple projecting from the opposite end of said pedestal extension, for threadably engaging said bushing seat threads; and a plastic insert adapted for insertion in said bushing seat, said plastic insert having an external bushing taper substantially matching said bushing seat taper and at least one pair of longitudinal slots provided in said plastic insert for removably locking said pedestal extension in said plastic insert, whereby when said plastic insert is inserted in said bushing seat, said threaded nipple engages said bushing seat threads when said opposite end of said pedestal extension is inserted in said plastic insert and the seat pedestal is inserted in said pedestal extension, such that the seat is securely and removably mounted on the boat.

2. The seat pedestal of claim 1 wherein said plate flange and said bushing seat are formed integrally and said at least one pair of longitudinal slots further comprises a first pair of longitudinal slots extending from the bottom of said plastic insert into said plastic insert and a second pair of longitudinal slots extending from the top of said plastic insert into said plastic insert.

3. The seat pedestal mount of claim 2 wherein said plate flange and said bushing seat are cast in a selected metal and said first pair of longitudinal slots are disposed in substantially perpendicular relationship with respect to said second pair of longitudinal slots.

4. The seat pedestal mount of claim 1 further comprising a coil spring provided in said bushing seat for biasing said plastic insert and said pedestal extension upwardly in said bushing seat when the seat is vacant and when said pedestal extension is unthreaded from said bushing seat.

5. The seat pedestal of claim 1 wherein said plate flange and said bushing seat are cast in a selected metal and further comprising a coil spring provided in said bushing seat for biasing said plastic insert and said pedestal extension upwardly in said bushing seat when said threaded nipple is unthreaded from said threads in said bottom of said bushing seat and the seat is vacant.

6. The seat pedestal mount of claim 1 further comprising a seat shoulder shaped in the inside top of said bushing seat, said seat shoulder characterized by a substantially uniform seat shoulder diameter, a seat bevel extending from said seat shoulder to define said internal bushing seat taper and a seat base extending downwardly from said seat bevel, said seat base characterized by a substantially uniform seat base diameter.

7. The seat pedestal mount of claim 6 wherein said plastic insert further comprises a cap at the top exterior thereof, said cap characterized by a substantially uniform cap diameter and a bushing bevel extending from said cap to define said external bushing taper, wherein a first pair of said longitudinal slots extend from the bottom of said plastic insert to define a pair of bushing legs in facing relationship for removably seating said pedestal extension in said plastic insert and said plastic insert in said bushing seat.

8. The seat pedestal mount of claim 7 wherein said plate flange and said bushing seat are formed integrally and wherein a second pair of longitudinal slots extend from the top of said plastic insert into said plastic insert and further comprising a coil spring provided in said bushing seat for biasing said plastic insert and said pedestal extension upwardly in said bushing seat when the seat is vacant and said pedestal extension is unthreaded from said bushing seat.

9. The seat pedestal mount of claim 8 wherein said plate flange and said bushing seat are cast in a selected metal and said first pair of longitudinal slots are disposed in substantially perpendicular relationship with respect to said second pair of longitudinal slots.

10. A seat pedestal mount for removably mounting a seat having a seat pedestal on the deck of a boat, comprising a base plate having a plate flange adapted for mounting on the deck; an internally-tapered bushing seat downwardly-extending from said plate flange for recessing in the deck; a plastic insert having a longitudinal bore and an external taper substantially matching said internally-tapered bushing seat, for removably seating in said bushing seat and a pedestal extension having one end adapted for secure and tight insertion in said longitudinal bore and the opposite end of said pedestal extension adapted to receive the seat pedestal of said seat, for mounting said seat in stable relationship on the deck of the boat.

11. The seat pedestal mount of claim 10 further comprising seat threads provided in said bushing seat and a threaded nipple projecting from said one end of said pedestal extension for engaging said seat threads and threadably seating said pedestal extension in said plastic insert and said bushing seat.

12. The seat pedestal mount of claim 10 further comprising at least one pair of longitudinal slots provided longitudinally in said plastic insert across said longitudinal bore in facing relationship, for removably locking said pedestal extension in said plastic insert and said plastic insert in said bushing seat.

13. The seat pedestal mount of claim 15 further comprising a coil spring provided in said bushing seat, said coil spring adapted to engage said plastic insert and lift said plastic insert in said bushing seat when the seat is vacant.

14. The seat pedestal mount of claim 10 further comprising:

(a) a first pair of longitudinal slots extending from the bottom of said plastic insert upwardly into said plastic insert across said longitudinal bore and a second pair of longitudinal slots extending from the top of said plastic insert downwardly into said plastic insert across said longitudinal bore; and (b) seat threads provided in said bushing seat and a threaded nipple projecting from said one end of said pedestal extension for engaging said seat threads and threadably seating said pedestal extension in said plastic insert and said bushing seat.

15. The seat pedestal mount of claim 14 wherein said plate flange and said bushing seat are cast in a selected metal and said first pair of longitudinal slots are disposed in substantially perpendicular relationship with respect to said second pair of longitudinal slots.

16. A seat pedestal mount for removably mounting a seat having a seat pedestal on the deck of a boat, said seat pedestal mount comprising a base plate having a plate flange adapted for mounting on the deck; a bushing seat downwardly-extending from said plate flange for recessing in the deck, said bushing seat having an internal taper therein; a plastic insert seated in said bushing seat, said plastic insert having a longitudinal bore, a first pair of longitudinal slots extending from the bottom of said plastic insert through the wall thereof, across said bore, a second pair of longitudinal slots extending from the top of said plastic insert through the wall thereof, across said bore and an external taper provided in said plastic insert, said external taper shaped substantially in the configuration of said internal taper in said bushing seat; and a pedestal extension having one end adapted for secure and tight insertion in said longitudinal bore in said plastic insert and the opposite end of said pedestal extension adapted to receive the seat pedestal, for mounting the seat in stable relationship on the deck of the boat.

17. The seat pedestal mount of claim 16 further comprising threads provided in the bottom of said bushing seat and a threaded nipple projecting from said one end of said pedestal extension for engaging said threads and threadably seating said pedestal extension in said plastic insert and said bushing seat and wherein said plate flange and said bushing seat are cast in a selected metal.

18. The seat pedestal mount of claim 17 further comprising a coil spring provided in said bushing seat, said coil spring adapted to engage said plastic insert and lift said plastic insert in said bushing seat when said threaded nipple is unthreaded from said threads and the seat is vacant.

* * * * *